United States Patent [19]

Suzuki

[11] Patent Number: 5,077,581

[45] Date of Patent: Dec. 31, 1991

[54] IMAGE FORMING APPARATUS WITH DETACHABLE MEMORY TO PROVIDE A PROCEDURE DISPLAY FEATURE

[75] Inventor: Tadashi Suzuki, Yokohama, Japan

[73] Assignee: Canon Kabushiki Kaisha, Tokyo, Japan

[21] Appl. No.: 593,272

[22] Filed: Oct. 1, 1990

Related U.S. Application Data

[63] Continuation of Ser. No. 218,146, Jul. 13, 1988, abandoned.

[30] Foreign Application Priority Data

Jul. 27, 1987 [JP] Japan ..... 62-188300

[51] Int. Cl.[5] ..... G03G 15/00

[52] U.S. Cl. ..... 355/200; 355/209

[58] Field of Search ..... 355/200, 203, 204, 206, 355/209, 313

[56] References Cited

U.S. PATENT DOCUMENTS 4,699,501 10/1987 Watanabe et al. ..... 355/14 C X 4,711,560 12/1987 Hosaka et al. ..... 355/14 R X 4,742,483 5/1988 Morrell ..... 355/14 R X

FOREIGN PATENT DOCUMENTS 0192119 4/1986 European Pat. Off. .

OTHER PUBLICATIONS

Patent Abstracts of Japan, vol. 11, No. 15 (P-536) (2462) Jan. 16, 1987; & JP-A-19-351 ("Toshiba" 25.08, 1986.

Patent Abstracts of Japan, vol. 10, No. 256 (P-493) (2312) Sep. 2, 1986; & JP-A-61 83552 (Mitsubishi Electric) 28.04, 1986.

*Primary Examiner*—Joan H. Pendegrass

*Attorney, Agent, or Firm*—Fitzpatrick, Cella, Harper & Scinto

[57] ABSTRACT

The image forming apparatus is provided with a detachable particular memory, which, when mounted displays the servicing information on the apparatus, so that the servicing personnel can perform servicing procedure without the ordinary servicing manual.

15 Claims, 7 Drawing Sheets

IMAGE FORMING APPARATUS WITH DETACHABLE MEMORY TO PROVIDE A PROCEDURE DISPLAY FEATURE

This application is a continuation of application Ser. No. 07/218,146, filed July 13, 1988, now abandoned.

BACKGROUND OF THE INVENTION

1. Field of the Invention

The present invention relates to an image forming apparatus with a detachable memory medium, which, when attached, enables the use of data stored therein.

2. Related Background Art

In conventional image forming apparatus such as a copying apparatus, the installation procedure and the maintenance procedure have been conducted by the service person, for example, with reference to a manual. However, with the recent progress in the functions of such apparatus, the amount of such procedure has significantly increased and has inevitably lead to errors and mistakes in such procedures.

SUMMARY OF THE INVENTION

In consideration of the foregoing, an object of the present invention is to provide an improved image forming apparatus.

Another object of the present invention is to provide an image forming apparatus capable of improving the operability at the installation or at the servicing.

Still another object of the present invention is to provide an image forming apparatus capable of reducing mistakes at the installation or at the servicing.

The foregoing and still other objects of the present invention, and the advantages thereof, will become fully apparent from the following description to be taken in conjunction with the attached drawings

DETAILED DESCRIPTION OF THE PREFERRED EMBODIMENTS

Now the present invention will be explained in detail by an embodiment thereof shown in the attached drawings.

Figure 1:
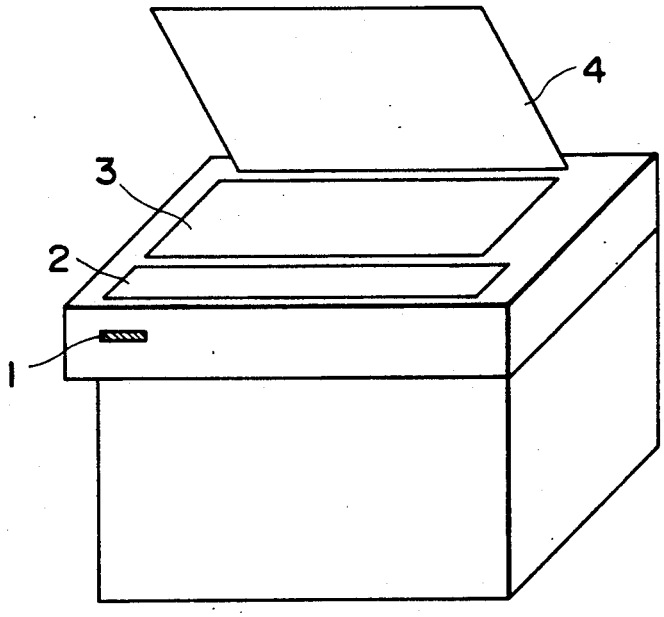
FIG. 1 is a perspective view of a copying apparatus embodying the present invention.

FIG. 1 is a perspective view of a copying apparatus embodying the present invention.

In FIG. 1, there are shown an attaching slot 1 for an IC card; an operation panel 2 provided with plural keys for entering the intention of the operator and a display unit for displaying the mode or state of operation; an original supporting glass plate 3 for placing an article to be copied thereon; and a pressure plate 4 for pressing said article.

Figure 2:
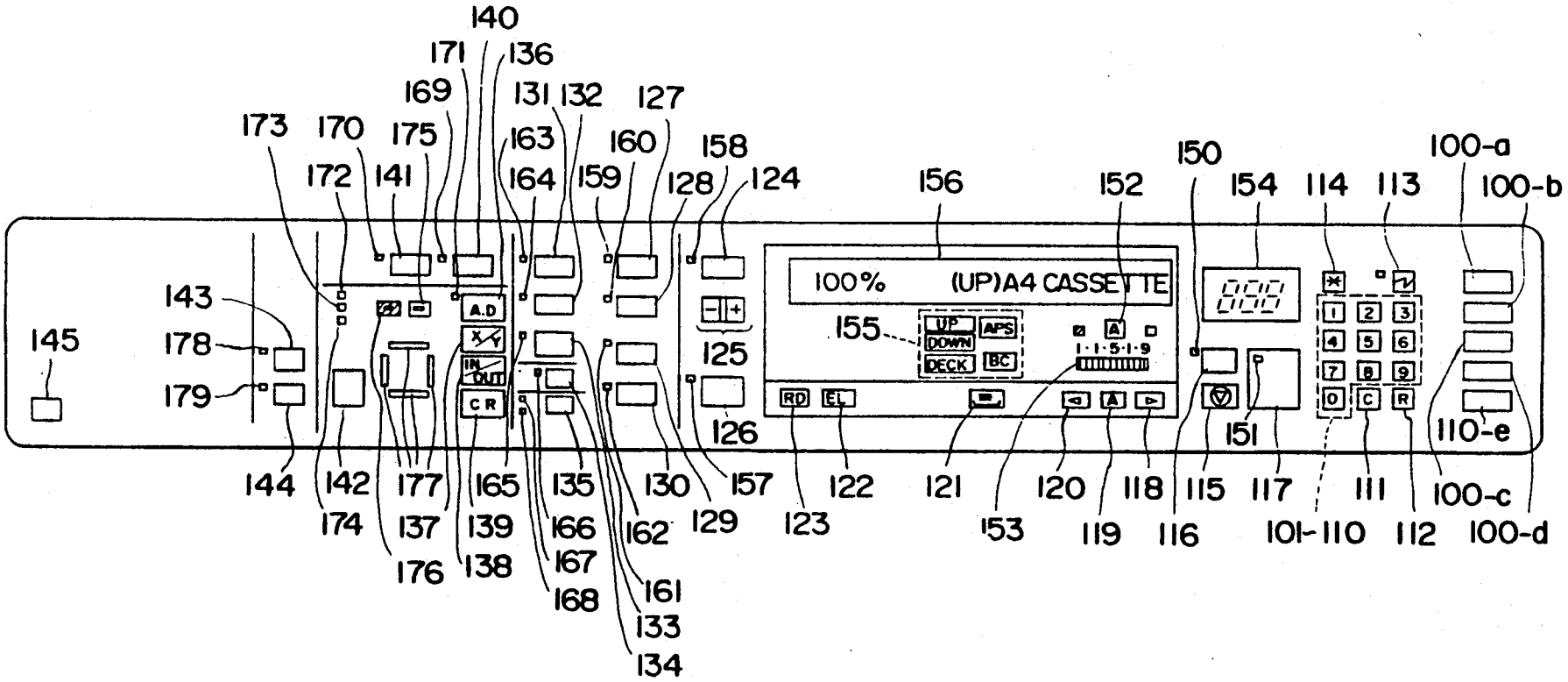
FIG. 2 is a plan view of an operation panel of the copying apparatus shown in FIG. 1.

FIG. 2 is a plan view of the operation panel, of which keys will be explained in the following.

Function keys 100*a*–100*e* are used for storing and recalling various copying modes to be arbitrarily set by other keys of the operation panel, and are capable of storing five different modes at maximum. It is therefore possible to store a mode frequently used by the user, or to store an image magnification or a designated area to be used by the user, and to establish a desired copying mode immediately with a single key operation. In the present copying apparatus, the memory is retained by a back-up power supply.

Numeral keys 101–110 are used for entering the copy number and also for entering, in combination with an asterisk key, data for various asterisk modes.

A clear key 111 is used for clearing the preset copy number or other data. A reset key 112 is used for restoring a standard copying mode from a preset mode. There are also provided a preheating key 113; an asterisk key 114 for setting various asterisk modes; a copy stop key 115; and a color key 116 for selecting one of plural developing units provided in the copying apparatus. When a color developing unit is selected, an LED 150 is turned on to provide a status indication.

In a copy start key 117, an LED 151 is lighted green when the copying operation is enabled (except during a copying operation), or lighted red otherwise. An AE key 119 selects an AE (automatic exposure) mode in which the developing bias is corrected in response to the detection of the original density, thereby providing a copy of appropriate density. An indicator 2 is lighted when the AE mode is selected. Manual density adjusting keys 118, 120 allow to increase or decrease the image density to a desired level. The keys 118, 120 respectively, elevate or lower the density, and the indicated level of an indicator 153 varies correspondingly.

Indicators 152, 153 indicate the density conditions, and a 7-segment display unit shows the number of copies.

A cassette selection key 121 is used for manually selecting a paper cassette. The present apparatus is also provided with an automatic paper selection (APS) function, in which an appropriate sheet is selected in response to the detected original size and the selected image magnification. Indicators 155 indicate a selected paper cassette, or that the APS mode has been selected.

There are further provided a key 122 for selecting predetermined image enlarging rates, a key 123 for selecting predetermined image reducing rates, and a key 124 for selecting an automatic magnification selecting (AMS) mode, in which the image magnification is automatically selected from the detected original size and the selected cassette size. An indicator 158 is lighted when the AMS mode is selected. Zoom keys 125 allow one to vary the image magnification with a pitch of 1%, by means of a "+" key and a "−" key. An equal size key 126 is used for selecting an equal size (100%) mode, and an indicator 157 is lighted when said equal size mode is selected.

A dot matrix liquid crystal display unit 156 is usually used for displaying the selected image magnification, selected cassette size, copying mode etc., but is used also as a message display in case of a failure of the apparatus, an error of the operator and for a complex operation procedure.

A one-two side selection key 127 for selecting a mode of copying two one-side originals on both sides of a copying sheet by means of an intermediate tray in the apparatus. A two-one side selection key 128 for selecting a mode of copying a two-side original on a side of two copying sheets, by means of a recycling document feeder (RDF). A two two side selection key 129 selects a two two side copying mode for copying two-side original on both sides of a copying sheet, utilizing the intermediate tray and the RDF. A multiple copying key 130 selects a multiple copying mode for superposing two or more images on the same side of a copying sheet, utilizing the intermediate tray.

In response to the depression of any of the keys 127–130, there is lighted one of indicators 159–162.

A continuous page copying key 131 selects a mode of scanning the left half and the right half of an original in two scanning operations and obtaining two copies A, B.

A continuous multiple page copying key 132 for superposing the images of said copies A, B on the same side of a copying sheet.

A two-side continuous page copying key 133 for forming the images of said copies A, B, respectively on two sides of a copying sheet, utilizing the intermediate tray. A frame erasing key 134 is used for erasing the shadow appearing at the perimeter or at the center of an opened book original in the foregoing continuous page copying modes.

An image shift key 135 shifts the image to right or to left. The amount of shift can be regulated by actuating numeral keys while said image shift key is depressed, and can be stored by the function keys 100*a*–100*e*.

An area designation key 136 is also used for cancelling the area designation The area designation can be achieved in an original preferential mode, in which the size of the designated area is variable according to the image magnification, or a cassette preferential mode, in which the size of designated area is constant regardless of the image magnification. An X/Y key 137 is used for data entry when the area designation is made with the numeral keys An in/out key 138 is used for selecting the image development inside or outside the designated area.

A correction key 139 is used for recalling and correcting the values of designated area.

A key 140 is used for inside or outside blanking of an area in the multiple copying mode, and automatic switching of developing color When this key is selected in the multiple copying mode, the inside and outside blanking and the image color are automatically switched between the copies A and B.

A key 141 is used for automatic color change in the continuous page copying mode, for automatically changing the image color between the above-mentioned copies A and B. An indicator 170 is lighted when the key 141 is depressed.

LED's 157–171 are indicators for showing the selected modes. Indicators 172–174 indicate the number of designated areas. In the present apparatus, there can be designated three areas at maximum. Indicators 175, 176 for indicating the inside/outside blanking, are selectively lighted according to the mode selected by the key 138. Indicators 177 show the designated value corresponds to $X_{min}$, $X_{max}$, $Y_{min}$ or $Y_{max}$. An area designation key 142 with CCD causes a scanning operation with the optical system, thereby recognizing an area drawn on the original document A sort key 143 and a collate key 144, respectively, select the sorting mode and the collating mode, which are respectively indicated by indicators 178, 179.

An IC card key 145, related to the present invention, cyclically switches the display of the operation unit to the IC card mode and the normal mode when the IC card is mounted.

Figure 3:
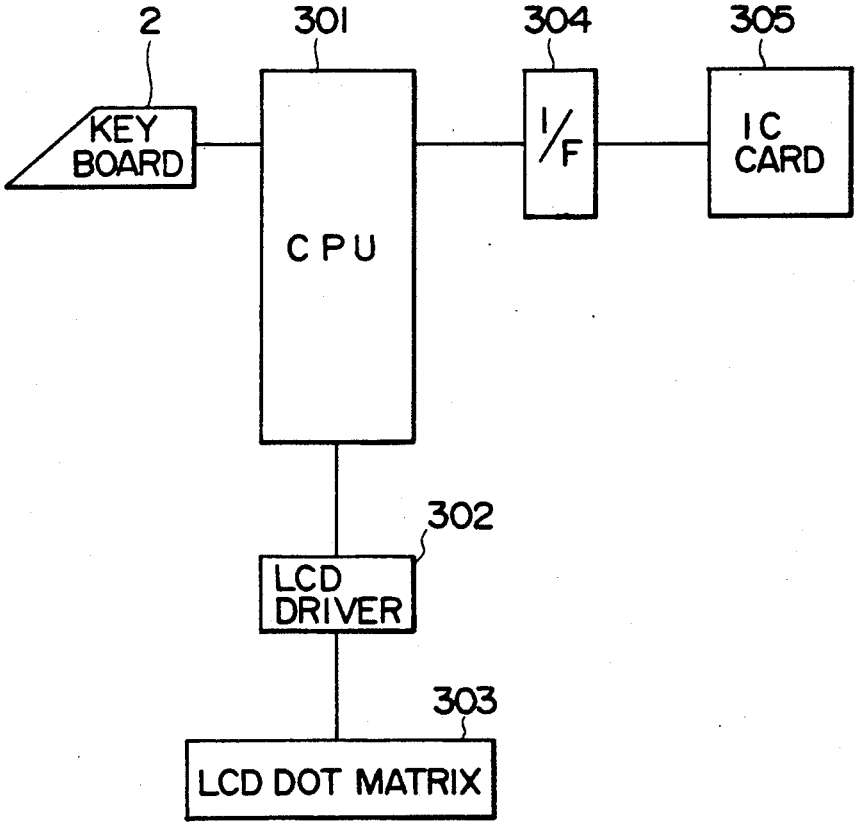
FIG. 3 is a block diagram of a control unit of the copying apparatus shown in FIG. 1.

FIG. 3 is a block diagram of the control unit of the copying apparatus shown in FIG. 1. A CPU 301 controls the copying operation and the operation panel of the apparatus. An LCD driver controller 302 displays a message on the LCD dot display unit 303, corresponding to the liquid crystal display unit 156 shown in FIG. 2, in response to control signals from the CPU 301. An IC card interface 304 functions as a buffer for the serial communication between the CPU 301 and the IC card 305 incorporating a CPU, a ROM and a RAM, when said IC card is mounted.

The IC card 305 transmits CG (character generator) codes of messages to be displayed in the operation panel.

Figure 4:
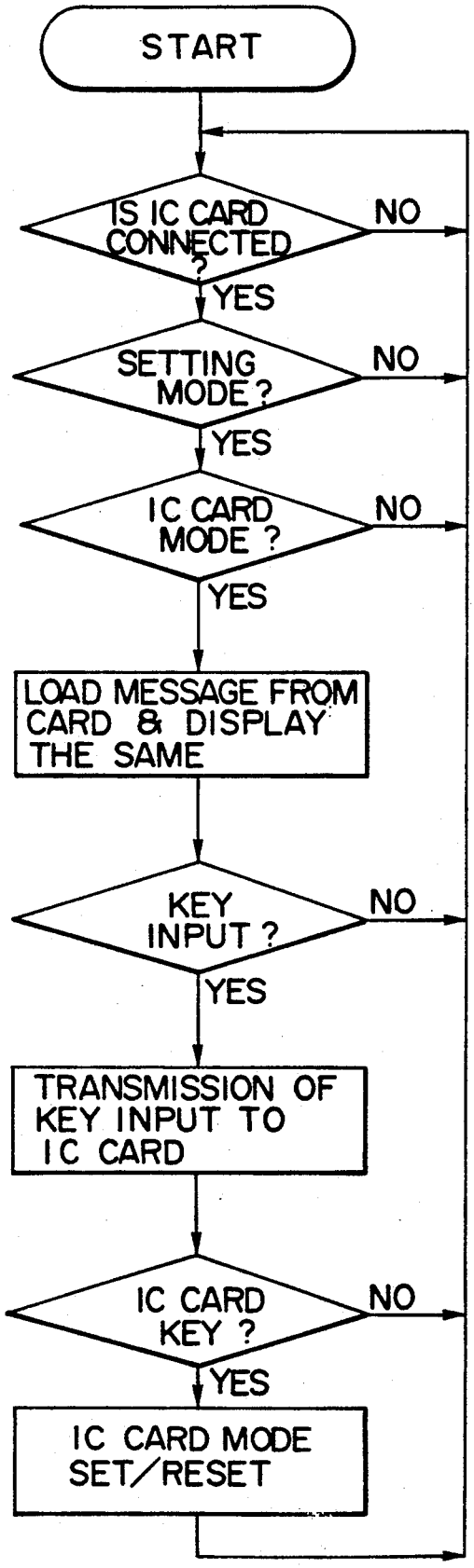
FIG. 4 is a flowchart of the control sequence to be executed by a CPU of said copying apparatus.

FIG. 4 is a flowchart of the control sequence to be executed by the CPU 301 of the apparatus.

When the IC card 305 is mounted, and is identified to contain information relating to the installation manual, the message display unit 156 of the operation panel preferentially displays the information (character codes) from the IC card 305. Also the data entered by the numeral keys 101–110 are transmitted to the IC card 305, and the apparatus remains irrelevant to such display or data entry.

The IC card key 145 cyclically selects the IC card mode and the non-IC card mode, and, in the latter, the display and the key input are conducted in the normal mode.

Figure 5A:
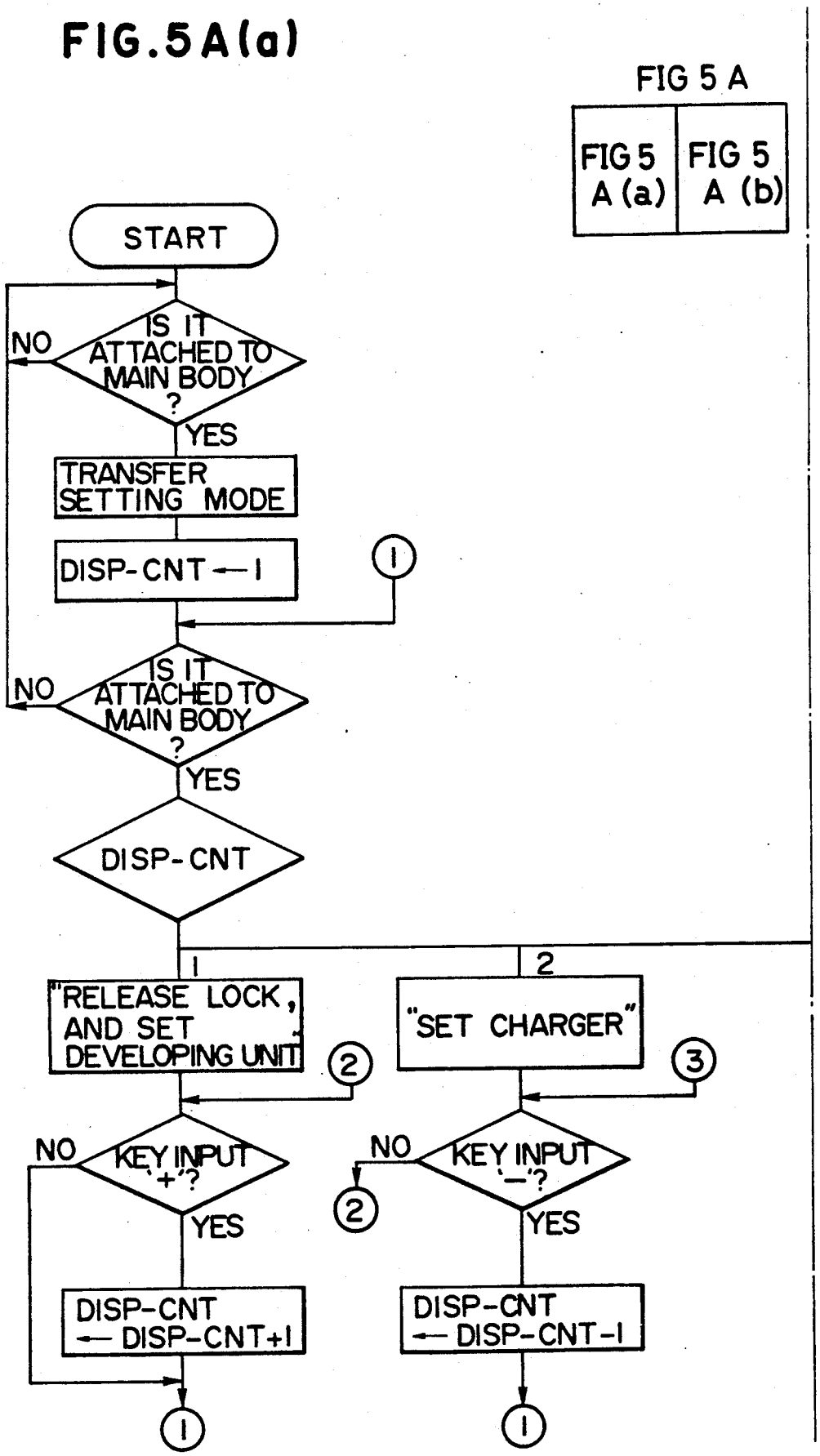
FIG. 5A, consisting of FIGS. 5A(*a*) and 5A(*b*), and FIG. 5B are flowcharts of the control sequence to be executed by an IC card.
Figure 5A:
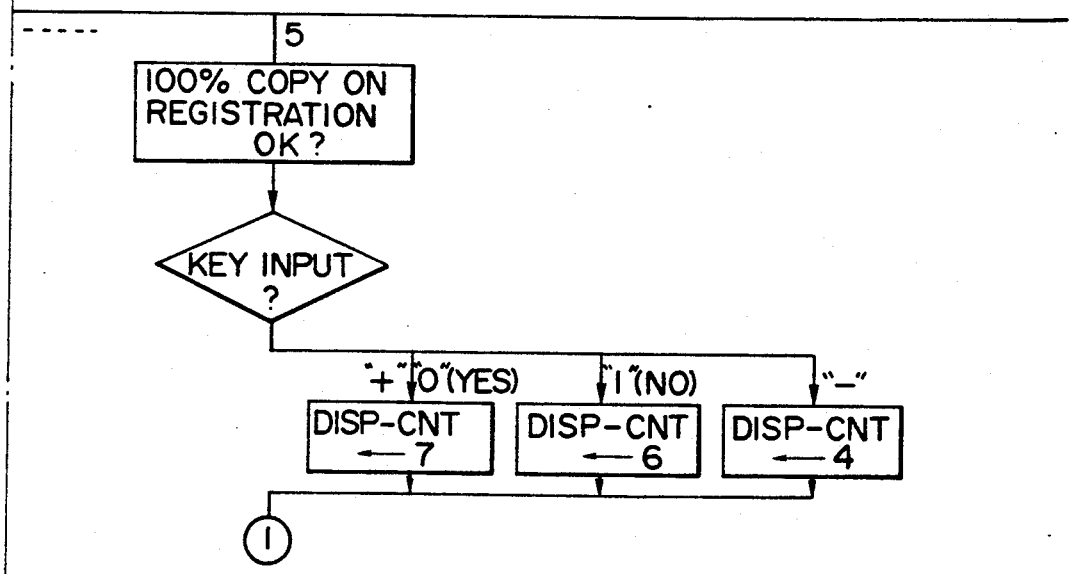
Figure 5B:
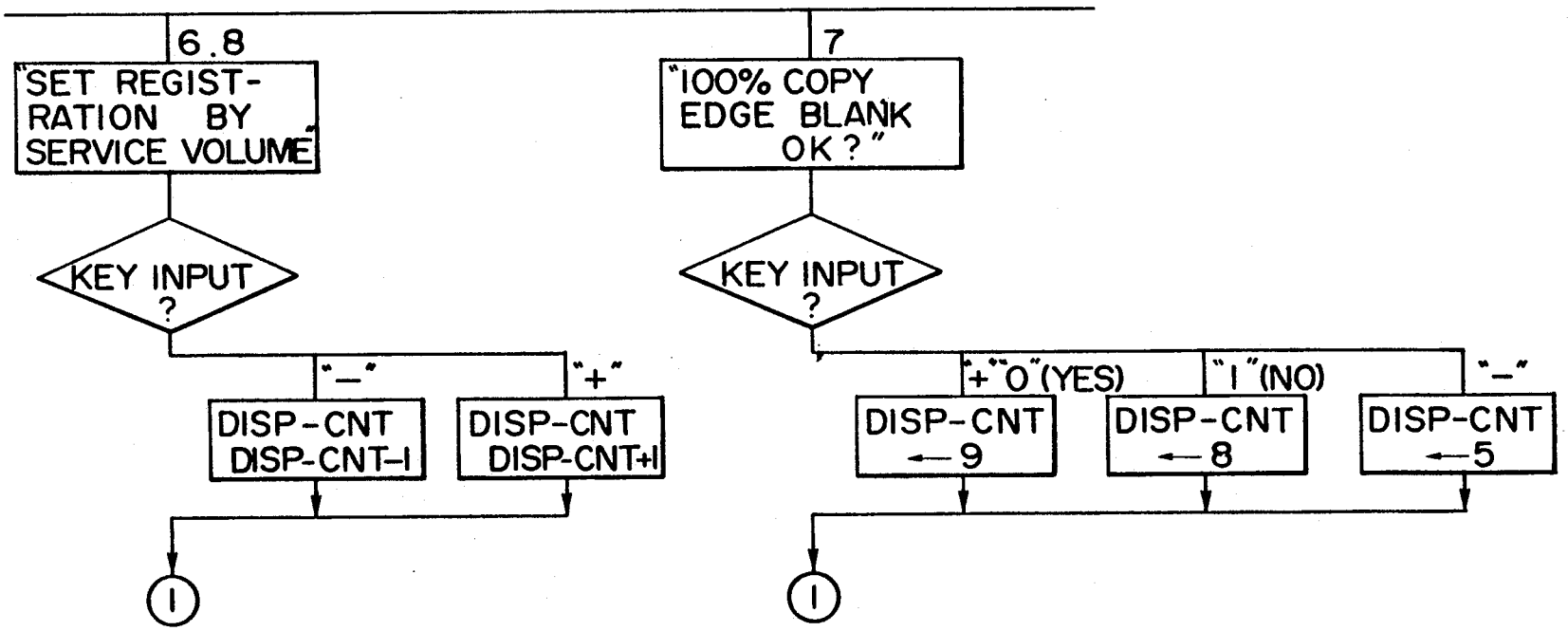

FIG. 5 is a flowchart of the control sequence of the IC card.

When mounted on the apparatus, the IC card transmits that the memory of the IC card is in the installation mode, then sets a counter Disp-CNT to "1", and transmits an initial message:

"Release lock and set developing unit". This message is sent to the CPU 301 of the copying apparatus, character by character in CG codes. The IC card then receives the key data from the copying apparatus, then performs increment of the counter Disp-CNT in response to the entry of "+" key, and transmits a next message. Thereafter the message data are selected according to the actuation of the "+" or "−" key in the copying apparatus.

When the discrimination of the operator is requested, for example a message "100% copy on registration OK?" shown in FIG. 5, a next message is selected also in response to "0" (yes) or "1" (no), in addition to the "+" and "−" keys.

As will be apparent from the foregoing flow charts, the copying apparatus is not involved in these displays, and the suitable message is selected by the IC card in response to the data entered by the numeral keys.

When a serviceman installs the copying apparatus of the above-explained structure, he starts the power supply according to a predetermined procedure, and mounts the IC card 305 into the slot 1.

The apparatus displays the message:

"Release lock and set developer unit" sent from the IC card. After performing the instruction, the serviceman depresses the zoom key "+". The corresponding key data are sent to the IC card, which, in response, transmits a next message:

"Set charger".

The IC card does not respond to any other key.

The installation procedure is thereafter executed by the actuations of the zoom key "+" to display a new message. The message is changed or renewed with each depression of the zoom key "+" which serves as a renewal means. The "−" key is depressed when returning the procedure to the preceding step. In the course of installation procedure, the normal operation mode of the displays and key operations can be restored by depressing the IC card key 145. A repeated actuation of said key 145 again shift the apparatus to the installation mode with the IC card. Thus, when the IC card mode is cancelled with the IC card key 145, the copying apparatus functions as if the IC card is not mounted.

Thereafter the serviceman performs the installation procedure until a message:

"Installation is completed"

is obtained from the card data.

In this manner the serviceman can perform the installation of the apparatus according to a memory medium such as an IC card without mistakes even in case of a complicated installation procedure, and the apparatus can provide advanced functions without additional burden of software. Also the messages can be displayed in various languages by simply changing the IC card, without any change in the apparatus itself.

Also the servicing man handling several different apparatus needs only to carry the IC cards corresponding to these apparatus, instead of several heavy manuals.

The memory medium in the present invention is not limited to the IC card shown in the foregoing embodiment but can be another suitable memory medium, for example an optical card.

Also the stored information is not limited to the information of installation manual but can be other information, for example that for maintenance or inspection.

I claim:

1. An image forming apparatus with detachable memory medium storing a plurality of display messages for indicating a plurality of procedures for a predetermined processing, comprising:

image forming means for image formation on a recording material;

plural key input means each provided for entering information related to the image formation;

display means for displaying the information entered from said key input means;

setting means adapted for setting thereto the memory medium; and control means for providing such a control that the display messages are read out from the memory medium set to said setting means, and then displayed on said display means, wherein said control means controls said display so as to renew in turn said plurality of display messages for a predetermined processing every time when information is entered from a specified key input means.

2. An image forming apparatus according to claim 1, wherein said image forming means is capable of image formation on a recording material with different image magnifications, and said specified key input means is adapted to enter said image magnification.

3. An image forming apparatus according to claim 1, wherein said predetermined processing is installation service of said apparatus.

4. An image forming apparatus according to either one of claims 2 or 3, wherein said memory medium is an IC card.

5. An image forming apparatus with detachable memory medium storing display information for indicating a procedure for a predetermined processing, comprising:

image forming means for image formation on a recording material;

key input means for entering information related to the image formation;

display means for displaying the information entered from said key input means;

setting means adapted for setting thereto the memory medium;

control means for providing such a control that the display information is read out from the memory medium set to said setting means, and then displayed on said display means; and switching signal input means for entering a signal for changing over the display content of said display means, wherein during display of said display information by said display means, said control means controls said display means so as interrupt the display of said display information in response to input from said switching signal input means and cause said display means to display the information related to image information.

6. An image forming apparatus according to claim 5, wherein the predetermined processing is installation service of said apparatus.

7. An image forming apparatus according to claim 5, wherein said image forming means is capable of image formation on a recording material with different image magnifications, said key input means is adapted to enter the amount of image magnification.

8. An image forming apparatus according to either one of claims 5, 6, or 7 wherein said memory medium is an IC card.

9. An image forming apparatus with detachable memory medium storing a plurality of display messages for indicating a plurality of procedures for a predetermined processing, comprising:

image forming means for image formation on a recording material;

plural key input means each for entering information related to the image formation;

display means for displaying the information entered from said key input means;

setting means adapted for setting thereto the memory medium;

control means for providing such a control that a selected display message is read out from the memory medium set to said setting means, and then displayed on said display means;

first switch means for initiating a control operation to display in turn a next display message pertaining to the procedures; and second switch means for initiating a control operation to display in turn a preceding a display message pertaining to the procedures.

10. An image forming apparatus according to claim 9, wherein said predetermined processing relates to installation service of said apparatus.

11. An image forming apparatus according to claim 9, wherein said image forming means is capable of image formation on a recording material with different image magnifications, and said first switch means includes key input means for entering said image magnification.

12. An image forming apparatus according to claim 11, wherein said key input means is adapted for increasing the image magnification on a predetermined unit basis.

13. An image forming apparatus according to claim 9, wherein said image forming means is capable of image formation on a recording material with different image magnifications, and said second switch means includes key input means for entering said image magnifications.

14. An image forming apparatus according to claim 13, wherein said key input means is adapted for decreasing the image magnification on a predetermined unit basis.

15. An image forming apparatus according to any one of claims 9 through 14, wherein said memory medium is an IC card.

* * * * *

UNITED STATES PATENT AND TRADEMARK OFFICE

CERTIFICATE OF CORRECTION

PATENT NO. : 5,077,581

DATED : December 31, 1991

INVENTOR(S) : Tadashi Suzuki

It is certified that error appears in the above-identified patent and that said Letters Patent is hereby corrected as shown below:

On the Title page:

[57] ABSTRACT:

Line 2, "mounted" should read --mounted,--.

COLUMN 2:

Line 29, "indicator 2" should read --indicator 152--.
Line 58, "dot matrix" should read --dot-matrix--.

COLUMN 3:

Line 2, "two two" should read --two-two--.
Line 3, "two two" should read --two-two--.
Line 44, "color When" should read --color. When--.
Line 60, "sponds" should read --sponding--.

COLUMN 4:

Line 51, "flow charts," should read --flowcharts,--.

COLUMN 5:

Line 8, "shift" should read --shifts--.
Line 24, "servicing man" should read --serviceman--.
Line 52, "said display" should --said display means--.

UNITED STATES PATENT AND TRADEMARK OFFICE

CERTIFICATE OF CORRECTION

PATENT NO. : 5,077,581 Page 2 of 2

DATED : December 31, 1991

INVENTOR(S) : Tadashi Suzuki

It is certified that error appears in the above-identified patent and that said Letters Patent is hereby corrected as shown below:

COLUMN 6:

Line 32, "magnifications, said" should read --magnifications, and said--.

Line 35, "7 wherein" should read --7, wherein--.
Line 57, "a display" should read --display--.

Signed and Sealed this

Twenty-seventh Day of April, 1993

*Attest:*

MICHAEL K. KIRK

*Attesting Officer* *Acting Commissioner of Patents and Trademarks*